United States Patent [19]

Hyde et al.

[11] Patent Number: 4,541,825

[45] Date of Patent: Sep. 17, 1985

[54] LOW AIR PRESSURE METHOD AND APPARATUS FOR FORMING FILTER RODS

[75] Inventors: Rebecca A. Hyde; Harold T. Bloom, both of Charlotte; Thomas E. Morris, Concord, all of N.C.

[73] Assignee: Celanese Corporation, New York, N.Y.

[21] Appl. No.: 453,006

[22] Filed: Dec. 27, 1982

[51] Int. Cl.[4] ..... B31C 13/00

[52] U.S. Cl. ..... 493/44; 493/42; 493/48; 28/255; 28/273; 19/65 T; 57/350

[58] Field of Search ..... 493/42, 44, 48, 49, 493/50; 28/255, 273; 19/65 T; 57/350; 156/200, 166, 180

[56] References Cited

U.S. PATENT DOCUMENTS

| | | | |
|---|---|---|---|
| 3,032,829 | 5/1962 | Mahoney | 28/282 |
| 3,050,430 | 8/1962 | Gallagher | 156/166 |
| 3,099,594 | 7/1963 | Caines et al. | 156/180 |
| 3,173,188 | 3/1965 | Wexler | 156/200 |
| 3,323,961 | 6/1967 | Gallagher | 28/282 |
| 3,831,501 | 8/1974 | Bevington | 493/44 |
| 4,181,247 | 1/1980 | McFall | 28/255 |
| 4,411,641 | 10/1983 | Suzuki et al. | 493/46 |

*Primary Examiner*—Daniel C. Crane
*Assistant Examiner*—David B. Jones
*Attorney, Agent, or Firm*—Robert J. Blanke

[57] ABSTRACT

The present invention relates to high speed process and apparatus suitable for the preparation of cigarette filter rods having high tow utilization in terms of pressure drop per unit rod weight without producing substantial tow density variations. In accordance with this invention, it has been discovered that in a process for manufacturing filter elements from opened and deregistered crimped continuous filament tow, wherein said tow is conducted from a mechanical forwarding means through an aspirating jet positioned adjacent a compacting means and wherein means are provided for dissipating aspirating fluid, that filter rod pressure drop and weight variations are reduced by aspirating at low pressures and more specifically, at fluid pressures of not more than about 3 pounds per square inch gauge and by causing the aspirating fluid, at its point of contact with the continuous filament tow, to flow substantially in a direction axial to that of the tow.

4 Claims, 5 Drawing Figures

Fig. 2
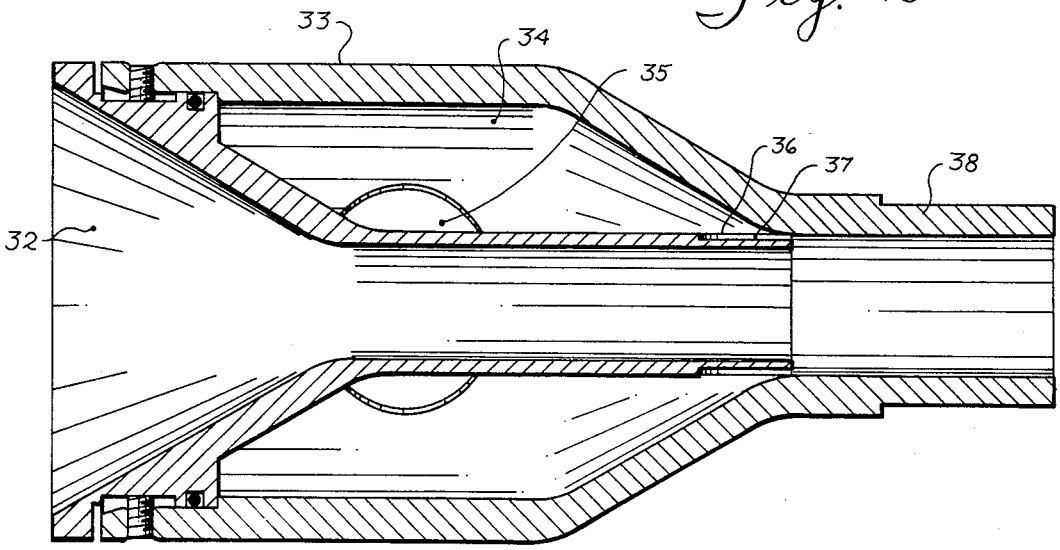
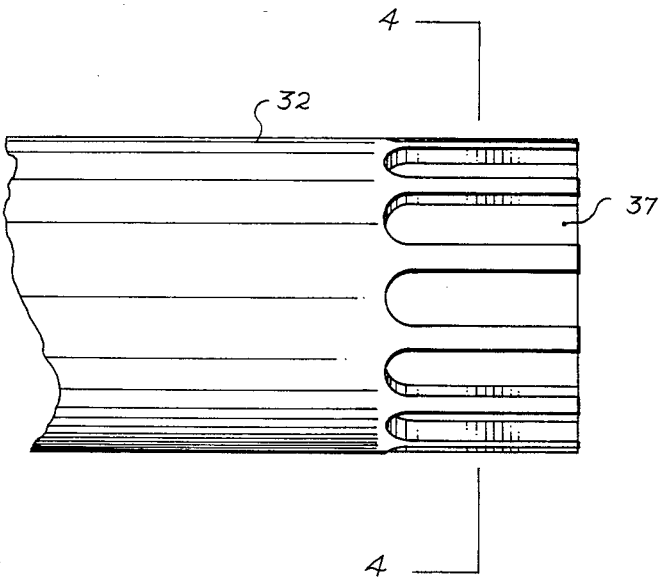
Fig. 3
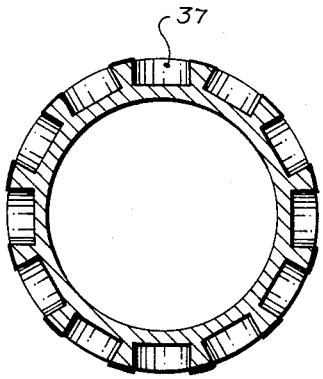
Fig. 4

LOW AIR PRESSURE METHOD AND APPARATUS FOR FORMING FILTER RODS

The present invention relates to improved processes and apparatus for the production of cigarette filter rods from continuous filament tow. More specifically, the invention relates to improved high speed processes and apparatus for the production of cigarette filter rods of reduced variability having high tow utilization in terms of pressure drop per unit rod weight.

In the last decade, the overwhelming proportion of commercially available cigarette filters have comprised longitudinally extended crimped filaments bonded to one another at their contact points by solvation bonds. The procedure for producing such filters involves producing a tow or untwisted bundle of several thousand continuous filaments, crimping the tow, opening the tow to deregister adjacent crimps, fluffing the tow to permit subsequent uniform application of a plasticizer, pulling the tow through the zones of plasticizer application and thereafter treating the plasticized tow to reduce its cross sectional size until it is approximately equal to the cross sectional size of a cigarette. The condensed mass is formed into a coherent structure, typically by wrapping paper around it and severing the wrapped tow into rods of predetermined length and thereafter curing the rods to affect bonding between adjacent filaments at their contact points.

Because of the expense of the tow component of the cigarette filter, it is desirable that the greatest amount of tow crimp and hence, tow bulk be attained per unit weight of filamentary material. One widely-used method of opening the tow consists of subjecting the tow while being fed along a predetermined path to a differential gripping action between a plurality of points spaced from one another transversely of the path so that certain laterally-spaced sections of the tow are positively gripped relative to other laterally-spaced sections of the tow. In this manner, there is produced as a function of the differential positive gripping of the tow, a relative shifting of adjacent filaments longitudinally of the tow, whereby the crimps are moved out of registry with one another. The longitudinal relative displacement of the fibers usually is combined with a relative lateral displacement between adjacent filaments of the tow whereby the combination of the two relative filaments movements bring about a complete opening of the tow.

This differential gripping action is accomplished by the provision before the plasticizing chamber of a pair of rollers, one of which is a smooth surface and the other of which is grooved over its entire peripherie. The tow is maintained under tension upstream of the differential gripping action so that after release of the tension on a downstream side of the differential gripping action, the tow blooms into a fluffy band which then passes through the plasticizer applying chamber, optionally after further lateral opening of the tow band, prior to feeding the tow band to the filter rod making machine.

Another widely-used method of opening tow is that set forth in U.S. Pat. No. 3,099,594 wherein crimped continuous tow is fed into a jet supplied with high velocity gas whereby the crimp in the filaments is put out of registry. More specifically, in the process of U.S. Pat. No. 3,099,594, a continuous multifilament crimped tow is withdrawn from a supply package by means of a feed roll pair and passed by the suction of a blooming jet over a suitable plasticizer applicator into a blooming jet. In the blooming jet, the tow is subjected to an explosive expansion of compressed air and while in the blooming jet, the bloomed tow is exposed to a fog of atomized plasticizer liquid. The plasticized tow is expelled from the jet under the influence of the expanding air flow into a feed roll pair operated at a somewhat slower speed than the first feed roll pair so that the tow is in a state of relaxation. The opened, plasticized and crimped deregistered tow is then passed into a filter rod-making machine.

While in the production of cigarette filter rods, optimum openness is desirable, the exact value for optimum openness varies from tow product to tow product. For instance, when a low degree of deregistry between the individual filaments comprising a tow bundle occurs, the resultant filter rods produced from such a tow bundle are too soft, difficult to wrap initially in forming the rods as well as in joining the rods to tubes of tobacco and making cigarette filters, and which do not spring after compression (as between the fingers or lips during smoking) with attended channelling of the smoke. For the same reasons, the opening equipment should not operate so strongly on the tow that the crimps are pulled out and the tow is of diminished bulk. While this could be compensated for by utilizing heavier tows, the resultant plugs would be so dense as to make it exceedingly uncomfortable to draw smoke through the filter, i.e., its pressure drop would be too high. Additionally, the smoke removal efficiency of the filter rod must be maintained at acceptable levels.

One means for maximizing tow utilization, that is to say, improving pressure drop per unit rod weight, is set forth in U.S. Pat. No. 3,050,430. In U.S. Pat. No. 3,050,430, an improvement is set forth in the process sequence wherein filaments which have been previously opened up and treated with plasticizer are forwarded into a garniture for compacting and forming. Rather than employing a mechanical type of treatment to pull the filaments into the garniture whereby a substantial amount of crimp is lost, the Patentee pushes the band of opened-continuous crimped filaments into the rod compacting and forming means. The filaments fed in this manner are in a somewhat relaxed and untensioned state whereby a relatively large percentage of each filament may be positioned somewhat crosswise or perpendicular to the longitudinal axis of the filament bundle. To achieve this result, a pneumatic transport or forwarding jet, such as that disclosed in U.S. Pat. No. 3,016,945, is positioned reasonably adjacent the tongue of a rod forming member or garniture. The tongue is perforated so that air or aspirating fluid employed to push the filamentary material into the tongue will be radially exhausted. Alternatively, as disclosed in U.S. Pat. No. 3,173,188, an inverted shroud may be positioned intermediate the forwarding jet and the perforated tongue whereby a substantial portion of the aspirating gas is caused to flow in a direction opposite the movement of the filaments or exhaust through small holes in the rear wall of the shroud or funnel member. This fluid dissipation is in addition to the radial exhaust which takes place in the perforated tongue member.

Neither of the motivating or aspirating jets set forth in U.S. Pat. Nos. 3,016,945 or 3,173,188 are designed to operate at low air pressures, that is to say, neither of these jets will provide adequate forwarding action when operated at pressures of less than 6 pounds per square inch gauge. The inability of these prior art jets to be operable at low air pressures is due to air volume constraints in the design of the apparatus, that is to say, at reduced air velocities such as are the result of low air pressures, air volume is reduced to the point that the jets of U.S. Pat. Nos. 3,016,945 and 3,173,188 will not function as an aspirating or forwarding jet. Moreover, air turbulence is created when the motivating jet or aspirating jet apparatus of U.S. Pat. Nos. 3,016,945 and 3,173,188 are operated at low air pressures, the air turbulence being sufficient to disrupt the forwarding of the cigarette tow into the tongue or garniture of the rod forming apparatus. The use of low pressure air would be a considerable advantage in that in order to exceed 3 pounds per square inch gauge, compressed air must be employed which is considerably more expensive than low pressure air.

Regardless of the process for manufacturing filter rods, the filter rod must have a nominally constant cross sectional size and should be of uniform mass per unit length. The pressure drop or resistance to air flow through the filter rod should also be constant along its length. The length of the filter tip which is combined with a cigarette to form filter tip cigarettes may be in the range of 10 to 30 millimeters.

It is important from the smoker's point of view that the draw characteristics, the resistance to air flow through the length of the filter rod, should be reasonably uniform. Some factors influencing the resistance to air flow along a filter rod are the fiber density, by which is meant the number of fibers per unit cross sectional area; the denier of the fibers; the degree of crimping of the fibers; and the degree of fiber opening or "bloom". Some of these factors affect the mass per unit length of the filter rod so that variations of mass per unit length of the filter rod to some extent reflect variations in the resistance to air flow along the rod. The higher the mass per unit length of the rod, the greater the resistance to air flow through that length of filter rod.

There is an ever increasing concern among filtered cigarette manufacturing companies with improving productivity and quality, reducing waste, and generally cutting costs. New high speed rod making machines run at speeds of 400 meters per minute or more. Prior art rod making processes are generally designed to run at speeds of about 200 meters per minute. When running at speeds of 400 meters per minute or more, it has been found that the maximum tow utilization processes of the prior art produced the aforementioned undesirable tow density variations. Tow density variations, as previously noted, are undesirable since the resistance which filter rod sections, including such variations offer to the passage of cigarette smoke, varies rendering inconsistent the draw characteristics of cigarettes to which filter tips formed from such filter rod sections are applied.

Accordingly, it is an object of this invention to provide a high speed low air pressure process for the preparation of cigarette filter rods having high tow utilization in terms of pressure drop per unit rod weight without producing substantial tow density variations.

It is another object of this invention to provide high speed low air pressure apparatus suitable for the preparation of a cigarette filter rod having high tow utilization in terms of pressure drop per unit rod weight without producing substantial tow density variations.

Other objects and advantages of the invention will become apparent from the following detailed description and claims taken in conjunction with accompanying drawings wherein:

FIG. 2 is a cross sectional, not to scale, view of the low pressure forwarding jet used in the embodiment of FIG. 1.

FIG. 3 is an enlarged broken view of one component of the apparatus of FIG. 2.

FIG. 4 is a cross sectional view taken along the line IV, IV of FIG. 3.

Figure 1:
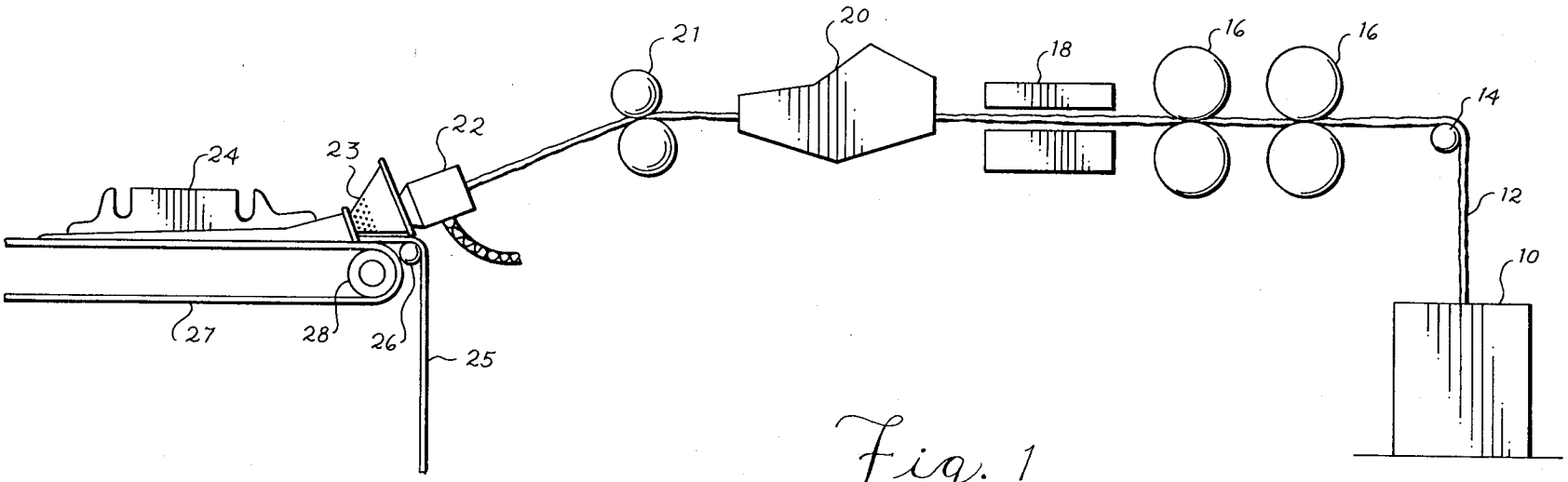
FIG. 1 is a diagramatic view of an apparatus suitable for the practice of the present invention.

In accordance with this invention, it has now been discovered that in a high speed process for the preparation of cigarette filter rods having high tow utilization in terms of pressure drop per unit rod weight, that tow density and pressure drop variations may be minimized by positioning downstream from the final set of feed rolls employed in a cigarette tow opening system, a low pressure aspirating jet. The low pressure aspirating jet has the ability to cause aspirating fluid to flow without turbulence substantially axially of said tow at the point of contact with said tow. The low pressure aspirating jet is nested into a perforated funnel member, the funnel member being nested into the tongue of a rod making device. The funnel member must have the ability to exhaust air from the pneumatic forwarding device. Preferably, the funnel member should have a volume sufficient to allow tow to be overfed and accumulate in a relaxed state within the funnel. It is also preferable that the funnel have a depth greater than or equal to $3\frac{1}{2}$ inches, an entrance diameter of about 4 inches and an exit diameter of about $1\frac{1}{4}$ inches. Most preferably, the perforations of the funnel are positioned nearest the exit end of the funnel. The exit end of the funnel is recessed into the tongue of the garniture of the rod making device, while the pneumatic forwarding jet is recessed into the mouth of the funnel. It should be understood that the tongue may be either perforated or unperforated for purposes of the instant invention.

The low pressure transport jet of this invention comprises an inner trumpet shaped member positioned within an outer trumpet shaped member, the inner and outer trumpet shaped members being fabricated such that when assembled, a plenum chamber is produced which encircles substantially all of said inner member. The outer trumpet shaped member is provided with a low pressure air entry and the inner trumpet shaped member is fluted at the exit portion thereof whereby air entering the plenum chamber is caused to flow in a direction substantially axially of the continuous filament tow being processed due to the fluid vectoring action of the flute members.

As previously noted, the process and apparatus of the instant invention provide a means for minimizing tow density variations in a high speed process for the preparation of cigarette filter rods having high tow utilization in terms of pressure drop per unit rod weight. By minimizing tow density variations or weight variations, pressure drop variations are also reduced. More specifically, it has been found that the process and apparatus of the instant invention will reduce pressure drop coefficient of variation to less than 4 and weight coefficient of variation to less than 2.5 for any combination of weight and pressure drop of a given tow item at any rod maker speed. The statistical investigation of the improvement obtained by the use of the apparatus and process of the instant invention is based on F-distribution. In F-distribution, when samples are taken from two independent populations, their variances are also independent and both $S_1^2$ and $S_2^2$ are unbiased estimators of the population variances if the populations are infinite or if sampling with replacement. That is to say, $S_1^2$ is an unbiased estimator of $\sigma_1^2$ (population standard deviation 1), and $S_2^2$ is an unbiased estimator of $\sigma_2^2$ (population standard deviation 2). The ratio of $\sigma_1^2$ to $\sigma_1^2$ is equal to 1.00 if the two variances are equal, and the mean ratio of $S_1^2$ to $S_2^2$ is also equal to 1.00 if the population variances are equal. If the two populations are both normal and have equal variances, then the ratio of the two sample variance values are distributed as F with $n_1 - 1$ and $n_2 - 1$ degrees of freedom.

The term coefficient of variation (CV) is a means for comparing the dispersion of two series by expressing the standard deviation as a percent of the mean of the series. In the instant invention, the mean of the series $\sigma$ is a value encompassing 66% of all samples. The coefficient of variation (CV) may then be defined as follows:

$$CV = \frac{\text{average sample deviation}}{\text{average sample value}} \times 100$$

A better understanding of the invention may be had by turning to FIG. 1 of the drawings wherein a tow 12 of continuous cellulose acetate filaments, preferably having about 5 to 32 crimps per inch, an acetyl value of 38 to 41 percent, a circular or non-circular cross-section, and a total denier of about 20,000 to about 120,000 or more is removed from a tow bale 10 and passed over guide means 14 to opener 16. The purpose of opener 16 is to cause deregistration of the crimps of the individual filaments and thus, provide a tow having improved uniformity and bulkiness. In the drawings, opener 16 is a threaded roll opener of the type generally described in U.S. Pat. Nos. 3,032,829 to Mahoney et al and 3,156,016 to Dunlap et al. Essentially, the threaded roll opener shown comprises two pairs of rolls with at least one roll of one pair being driven. Desirably, at least one roll of each pair has a patterned surface, preferably composed of circumferential or helical grooves. However, the roll pairs may be different, e.g. only one roll of one pair need be grooved. When the tow passes through the rolls, individual filaments of the tow are differentially restrained causing a longitudinal shifting of the relative location of the crimps of the individual filaments. It is to be understood of course, that other openers, for example, those producing deregistration by air turbulence or flexing of the tow may also be suitably employed.

After passing through opener 16, tow 12 is commonly passed through a banding jet 18 which spreads the tow by application of one or more air streams into a flat band of about 3 to 8 times its original width and causes further separation of the individual filaments. A suitable banding jet may be, for instance, that banding jet set forth in U.S. Pat. No. 3,226,773. However, other means for achieving filament separation, such as equipment utilizing electrostatic forces, are known in the art and may be used for this purpose.

The open tow is then passed through plasticizer applicator 20 which treats the surface of the individual filaments with a plasticizing liquid, preferably an organic ester such as triacetin to cause bonding of the filaments. Other suitable plasticizers include, for example, triethyl citrate, dimethylethyl phthalate, or the dimethyl ether of triethylene glycol. In the drawings, plasticizer applicator 20 may be a centrifugal plasticizer applicator of the type described in U.S. Pat. No. 3,387,992, which is a device employing a rotating disc for application of the plasticizer. Other applicators which are adapted to apply plasticizers to a continuous web include wick brush or spray nozzle type plasticizer applicators.

After treatment of the tow with plasticizer, the tow is passed into the nip of a pair of delivery rolls 21 and from there into low pressure forwarding jet 22. Pneumatic forwarding jet 22 pushes the open tow through perforated funnel member 23 which is positioned in the tongue of garniture member 24. Garniture member 24 is also supplied with suitable wrapping paper 25 by means of driven roll 26, both wrapping paper 25 and tow 12 being supported by means of endless belt member 27 which is driven by means of roller member 28.

A better understanding of the low pressure pneumatic forwarding jet may be had from FIG. 2 of the drawings. The jet is of trumpet-shaped construction. The jet is made up of inner member 32 and outer member 33. Inner member 32 has a flared portion at one end, which constitutes the tow feed funnel area. Inner member 32 and outer member 33 are fabricated such that when assembled, a plenum chamber 34 is provided which encircles substantially all of inner member 32. An opening into plenum chamber 34 is provided at 35 to which a large diameter pipe member is fitted for entry of low pressure air. The walls of chamber 34 converge on inner trumpet member 32 at exit opening 36. Inner trumpet member 32 is fluted at the exit opening with a plurality of longitudinal groove members 37 which have the ability to diminish fluid turbulence and vector fluid flow. The nature of the fluting is more readily apparent in FIG. 3 of the drawings and in FIG. 4 of the drawings which is a cross-section of FIG. 4 taken along the line IV, IV.

As can be seen in FIG. 3, inner member 32 has equispaced longitudinal grooves 37 disposed in the outside terminal portion thereof, the longitudinal grooves 37 being rectangular in cross-section so as to create a fluted area. The configuration of the longitudinal grooves 37 and resultant fluting may be readily seen in FIG. 4 of the drawings.

The cross sectional area of the grooves 37 will be referred to hereinafter as the flow straightening zone area. The grooved area in abutting relationship with outer member 34 will be referred to hereinafter as the flow straightening zone length. The flow straightening zone volume is calculated from the flow straightening zone length and the flow straightening zone area. Exterior trumpet member 33 terminates in a stem portion 38 which is of a diameter sufficiently small so as to be recessed into a receiving funnel member.

It should be understood that the optimum size of the low pressure jet of this invention is determined to a certain extent by the nature of the tow being supplied thereto, that is to say, by the total denier and denier per filament of the cigarette tow being processed into cigarette filter rods. Parameters which have been found to be especially suitable for the construction of the low pressure jet of this invention are as follows:

| Areas and Volumes | | |
|---|---|---|
| Plenum Chamber Volume | 10.371 $in^3$ | |
| Flow Straightening Zone Volume | 0.0261 $in^3$ | (optimum) |

-continued

| | | |
|---|---|---|
| | 0.0145 $in^3$ | (minimum) |
| | 0.0305 $in^3$ | (maximum) |
| Flow Straightening Zone Length | 0.100 in | (optimum) |
| | 0.180 in | (minimum) |
| | 0.210 in | (maximum) |
| Flow Straightening Zone Area | 0.145 $in^2$ | |
| Volume and Area Ratios | | |
| Plenum Volume to Flow Straightening Zone Volume | 397 | (optimum) |
| | 715 | (maximum) |
| | 340 | (minimum) |

A better understanding of the invention will be had from the following Examples which illustrate by comparison with prior art processes, the improvement in tow density variation obtained from the process and apparatus of this invention, and the preparation of cigarette filter rods having high tow utilization in terms of pressure drop per unit rod weight.

EXAMPLE I

Filter rods were prepared from 3.3 denier per filament trilobal cross-section cellulose acetate tow having a total denier of 44,000 using the embodiment depicted in FIG. 1 of the drawings at running speeds of 400 meters per minute, the run being for a period of 45 minutes with samples being taken every five minutes. Fifteen rods are selected from the aforementioned eight sample portions, the rods having preselected circumferences of 24.8+ or −0.05 millimeters. In order to eliminate possible variations induced by the addition of plasticizer however, plasticizer was not added as illustrated in FIG. 1 of the drawings, but rather the tow line was passed through the plasticizer apparatus running empty. The weight and encapsulated pressure drop of 102 millimeter rod lengths and corresponding coefficient of variations were determined for a plurality of target rod weights which were found to be as follows:

| Weight | CV | EΔP | CV |
|---|---|---|---|
| .6671 | .7603 | 271 | 2.05 |
| .7247 | .6860 | 338 | 1.77 |
| .7713 | .7274 | 395 | 2.37 |
| .8464 | 1.40 | 485 | 2.83 |
| .9402 | 1.10 | 615 | 2.75 |

EXAMPLE II

The process of Example I is repeated except that 2.9 denier per filament, trilobal cross-section cellulose acetate tow having a total denier of 35,000 is employed. The weight and encapsulated pressure drop of 102 millimeter rod lengths and corresponding coefficient of variations were determined and were found to be as follows for a plurality of target rod weights.

| Weight | CV | EΔP | CV |
|---|---|---|---|
| .6091 | 1.14 | 276 | 3.43 |
| .6395 | 1.05 | 311 | 2.71 |
| .6903 | 1.21 | 361 | 2.87 |
| .7771 | 1.41 | 476 | 2.90 |
| .8445 | 1.50 | 565 | 2.60 |

EXAMPLE III

The process of Example I is repeated except that filter rods were prepared from 4.2 denier per filament, trilobal cross-section cellulose acetate tow having a total denier of 40,000. The weight and encapsulated pressure drop of 102 millimeter rod lengths and corresponding coefficient of variation were determined for a plurality of target rod weights and were found to be as follows:

| Weight | CV | EΔP | CV |
|---|---|---|---|
| .6076 | 1.04 | 206 | 3.07 |
| .6903 | 1.47 | 278 | 2.79 |
| .7404 | 1.34 | 321 | 2.32 |
| .7956 | 1.62 | 378 | 3.71 |
| .8542 | 1.18 | 437 | 2.62 |
| .8887 | 1.09 | 486 | 1.61 |

EXAMPLE IV

The process of Example I is repeated except that filter rods were prepared from 3.3 denier per filament, trilobal cross-section cellulose acetate tow having a total denier of 35,000. The weight and encapsulated pressure drop of 102 millimeter rod lengths and corresponding coefficient of variation were determined for a plurality of target rod weights and were found to be as follows:

| Weight | CV | EΔP | CV |
|---|---|---|---|
| .5836 | .6925 | 253 | 1.77 |
| .6341 | 1.27 | 308 | 3.44 |
| .6640 | 1.08 | 336 | 2.48 |
| .7193 | 1.45 | 398 | 3.47 |
| .7593 | .8550 | 453 | 0.04 |
| .7931 | 1.67 | 499 | 3.68 |
| .8220 | 1.55 | 535 | 3.45 |

EXAMPLE V

The process of Example IV is repeated except that running speeds of 200 meters per minute are employed. The weight and encapsulated pressure drop of 102 millimeter rod lengths and corresponding coefficients of variation were determined for a plurality of target rod weights and were found to be as follows:

| Weight | CV | EΔP | CV |
|---|---|---|---|
| .5748 | 1.20 | 241 | 3.03 |
| .6112 | .913 | 276 | 2.34 |
| .6436 | 1.27 | 308 | 2.76 |
| .6860 | .9481 | 356 | 2.12 |
| .7879 | 1.56 | 483 | 2.68 |
| .8254 | 1.66 | 535 | 3.63 |
| .8240 | 2.03 | 536 | 2.61 |

EXAMPLE VI

A process of Example IV is repeated except that a non-perforated funnel is employed substantially preventing radial exhaust. The weight and encapsulated pressure drop of 102 millimeter rod lengths and corresponding coefficients of variations were determined for a plurality of target rod weights and were found to be as follows:

| Weight | CV | EΔP | CV |
|---|---|---|---|
| .5831 | .9337 | 249 | 2.23 |
| .5928 | 1.27 | 259 | 3.0 |
| .6289 | 2.20 | 295 | 4.92 |

-continued

| Weight | CV | EΔP | CV |
|---|---|---|---|
| .6617 | 1.11 | 326 | 4.09 |
| .6998 | 2.38 | 370 | 4.97 |

EXAMPLE VII

Filter rods were prepared from 2.9 denier per filament trilobal cross-section cellulose acetate tow having a total denier of 35,000 using the tow opening system as set forth in FIG. 2 of U.S. Pat. No. 3,099,594. However, in order to eliminate possible variations induced by the addition of plasticizer, the tow opening system was opened without the use of plasticizer. After exiting feed roll 7, as illustrated in FIG. 2 of U.S. Pat. No. 3,099,594, the opened deregistered tow was processed as illustrated in FIG. 1 of the drawings of the instant invention, that is to say the opened deregistered tow was then passed into nip rolls 21 of FIG. 1 of the drawings of the instant invention. Rod maker speeds of 400 meters per minute were employed. The weight and encapsulated pressure drop (EΔP) of 102 millimeter rod lengths and corresponding coefficients of variation were determined and were found to be as follows:

| Weight | CV | EΔP | CV |
|---|---|---|---|
| .6093 | 1.31 | 291 | 2.83 |
| .6239 | 1.24 | 302 | 3.59 |
| .6381 | 1.01 | 326 | 2.01 |
| .6812 | 1.34 | 378 | 2.06 |
| .7043 | 1.71 | 401 | 3.04 |
| .7403 | 1.64 | 460 | 3.41 |
| .7703 | 1.81 | 516 | 3.76 |

EXAMPLE VIII

The process of Example VII was repeated except that a pneumatic forwarding jet or transport jet, Model 61-0-0-EF marketed by Hauni-Werke Korber and Co., KG, Hamburg West Germany is employed rather than a low pressure jet of the instant invention. The jet marketed by Hauni-Werke Korber and Co. is designed to be operated at air pressures from 15 to 30 lbs. per square inch gauge and for purposes of this Example is operated at 25 lbs. per square inch gauge. When filter rods were prepared from the 2.9 denier per filament trilobal cross-section cellulose acetate tow having a total denier of 35,000, the weight and encapsulated pressure drop for a plurality of target rod weights of 102 millimeter rod lengths were determined and were found to be as follows:

| Weight | CV | EΔP | CV |
|---|---|---|---|
| .6159 | 1.39 | 298 | 2.83 |
| .6400 | 0.87 | 323 | 2.79 |
| .6595 | 1.71 | 355 | 3.30 |
| .7012 | 1.39 | 400 | 3.60 |
| .7215 | 1.22 | 434 | 2.71 |
| .7528 | 2.13 | 467 | 5.43 |
| .7849 | 2.77 | 529 | 6.48 |
| .8058 | 1.67 | 543 | 3.45 |
| .8266 | 3.66 | 590 | 6.53 |

EXAMPLE IX

The process of Example VII was repeated except that a pneumatic jet substantially as set forth in FIG. I of U.S. Pat. No. 3,262,178 was employed. For purposes of this Example, the jet of U.S. Pat. No. 3,262,178 is operated at about 15 to 25 pounds per square inch gauge. When filter rods were prepared from the 2.9 denier per filament trilobal cross-section cellulose acetate tow having a total denier of 35,000, the weight and encapsulated pressure drop for a plurality of target rod weights of 102 millimeter rod lengths were determined and were found to be as follows:

| Weight | CV | EΔP | CV |
|---|---|---|---|
| .6210 | 1.50 | 307 | 2.64 |
| .6221 | 1.84 | 310 | 3.13 |
| .6608 | 1.92 | 359 | 3.31 |
| .6789 | 1.41 | 381 | 3.89 |
| .7076 | 1.57 | 414 | 5.04 |
| .7450 | 2.29 | 472 | 4.73 |
| .8050 | 2.28 | 517 | 5.91 |
| .8485 | 3.32 | 575 | 6.10 |

EXAMPLE X

The process of Example I is repeated except that a pneumatic forwarding or transport jet, Model 61-0-0-DF marketed by Hauni-Werke Korber and Co., KG, Hamburg West Germany is employed rather than the low pressure jet of the instant invention. The jet marketed by Hauni-Werke Korber and Co. is designed to be operated at air pressures of from 15 to 30 pounds per square inch gauge and for purposes of this Example is operated at 25 pounds per square inch gauge. When filter rods were prepared from 3.3 denier per filament trilobal cross-section cellulose acetate tow having a total denier of 44,000, the weight and encapsulated pressure drop for a plurality of target rod weights of 102 millimeter rod lengths were determined and were found to be as follows:

| Weight | CV | EΔP | CV |
|---|---|---|---|
| .6705 | .369 | 265 | 1.84 |
| .7194 | 1.01 | 324 | 3.59 |
| .7617 | 1.21 | 375 | 4.13 |
| .8209 | .937 | 438 | 3.57 |
| .8758 | .871 | 500 | 3.17 |

EXAMPLE XI

The process of Example X is repeated except that filter rods were prepared from 2.9 denier per filament trilobal cross-section cellulose acetate tow having a total denier of 35,000. The weight and encapsulated pressure drop for a plurality of target rod weights of 102 millimeter rod lengths were determined and were found to be as follows:

| Weight | CV | EΔP | CV |
|---|---|---|---|
| .5994 | .876 | 264 | 2.58 |
| .6021 | .805 | 275 | 2.96 |
| .6262 | .716 | 300 | 2.98 |
| .6955 | 2.33 | 383 | 4.32 |
| .7593 | 2.00 | 469 | 4.24 |
| .8366 | 2.39 | 580 | 4.58 |

EXAMPLE XII

The process of Example X is repeated except that filter rods were prepared from 4.2 denier per filament trilobal cross-section cellulose acetate tow having a total denier of 40,000. The weight and encapsulated pressure drop for a plurality of target rod weights of 102 millimeter rod lengths were determined and were found to be as follows:

| Weight | CV | EΔP | CV |
|---|---|---|---|
| .6158 | .777 | 205 | 2.04 |
| .6745 | 1.22 | 256 | 2.12 |
| .7185 | 1.88 | 295 | 4.21 |
| .7718 | 2.35 | 348 | 3.28 |
| .8165 | 2.08 | 398 | 3.80 |
| .8860 | 1.51 | 469 | 4.77 |

EXAMPLE XIII

The process of Example X is repeated except that filter rods were prepared from 3.3 denier per filament trilobal cross-section cellulose acetate tow having a total denier of 35,000. The weight and encapsulated pressure drop for a plurality of target rod weights of 102 millimeter rod lengths were determined and were found to be as follows:

| Weight | CV | EΔP | CV |
|---|---|---|---|
| .6040 | 1.26 | 266 | 2.93 |
| .6576 | 1.44 | 319 | 3.32 |
| .7034 | 1.57 | 372 | 3.21 |
| .7634 | 1.67 | 447 | 3.68 |
| .8010 | 1.63 | 496 | 2.73 |
| .8481 | 1.47 | 554 | 4.29 |

Pressure drop (EΔP), as reported in the preceeding Examples, is measured by the following method:

Air is drawn through a 102 millimeter length of the fully encapsulated filter at a steady rate of 1050 cubic centimeters per minute and the resulting pressure difference across the filter is measured by means of an electronic pressure transducer. The result is expressed in millimeters of water at gauge. Rod weight is epressed as grams per filter rod.

It is apparent from the foregoing Examples, and more specifically Examples I to V, that the process and apparatus of the instant invention employing a mechanical or threaded roll tow opening system significantly reduces filter rod weight and pressure drop coefficient of variation at running speeds in the range of 200 to 400 meters per minute. Example VI is illustrative of the criticallity of the perforated funnel in the process and apparatus of the instant invention. The non-perforated funnel employed in Example VI clearly results in higher coefficients of variation for filter rod weight and pressure drop than the perforated funnel employed in Examples I to V. Example VIII illustrates that the process and apparatus of the instant invention employing a pneumatic tow opening system significantly reduces filter rod weight and pressure drop coefficient of variation at running speeds in the range of 200 to 400 meters per minute. Example VIII illustrates that a prior art pneumatic forwarding jet will not give the improved coefficients of variation obtainable with the pneumatic tow opening process and apparatus of the instant invention. Example IX illustrates that still another prior art pneumatic forwarding jet will not give the improved coefficients of variation obtainable with the pneumatic tow opening process and apparatus of the instant invention. Examples X to XIII illustrate that a prior art pneumatic forwarding jet will not give the improved coefficients of variation obtainable with the mechanical tow opening process and apparatus of the instant invention.

Figure 5:
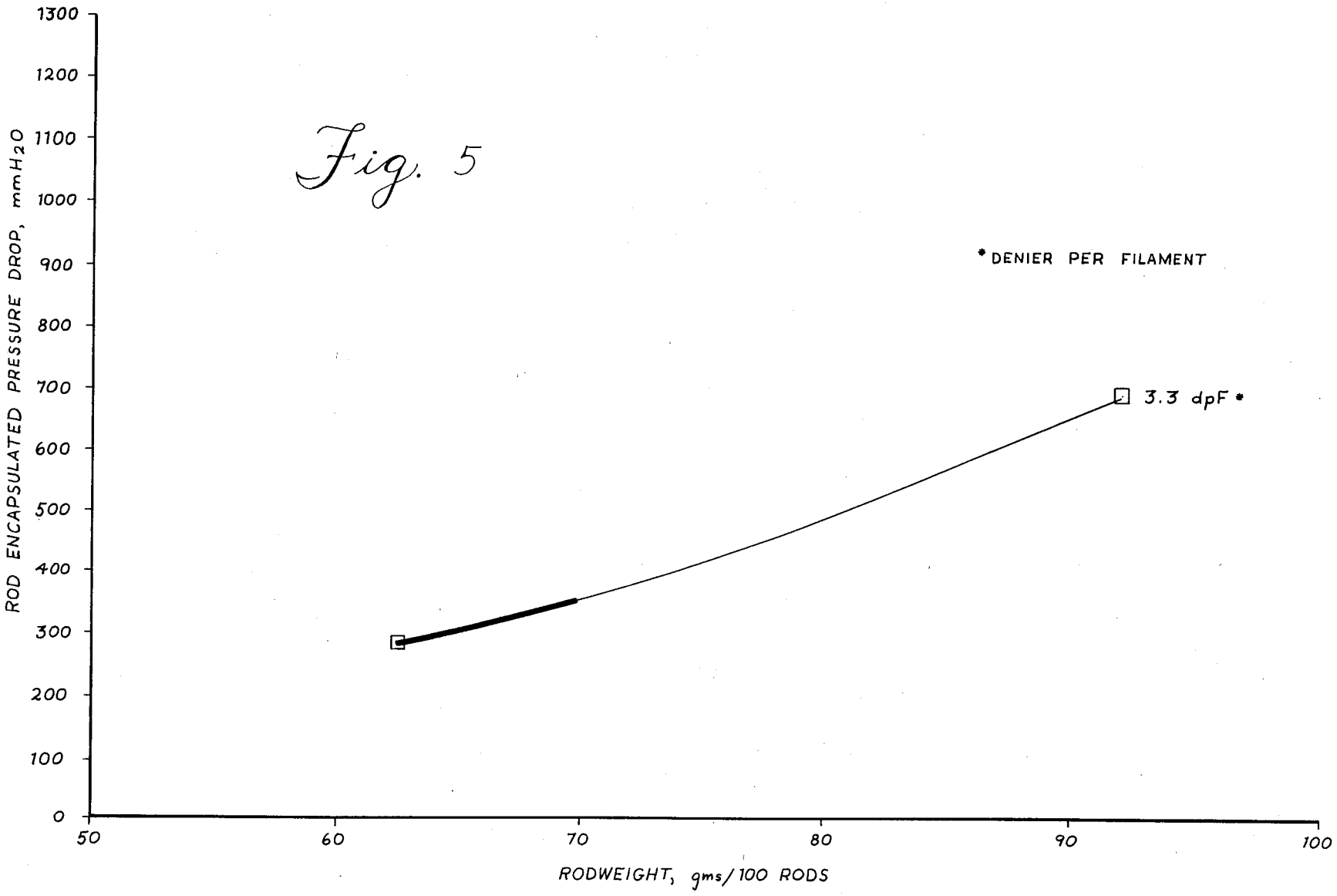
FIG. 5 is a graph plotting filter rod weight against pressure drop for a representative cigarette tow item.

The average value for 100-rod samples of specific length and circumference obtained at the minimum and maximum weight levels define the weight range capability and the pressure drop range capability of a specific tow item at these values are fairly constant under equivalent processing conditions. The improved versatility of a tow item as a result of this invention, is illustrated by FIG. 5 of the drawings wherein rod weight in grams is plotted against rod pressure drop in millimeters of water. As can be seen in FIG. 5 of the drawings, a vastly extended filter rod range is obtained for a 3.3 denier per filament tow item, the light line being representative of rods produced according to the teachings of the instant invention, while the heavy line is representative of the same tow item processed according to the prior art. It should be noted that the relationship between the rod pressure drops and the rod weight necessary to obtain that pressure drop is less than would be expected by linear extrapulation.

Having thus disclosed the invention, what is claimed is:

1. In an apparatus for the manufacture of continuous filament cigarette filter elements from previously opened and deregistered crimped continuous filament tow comprising mechanical filament forwarding means, an aspirating jet and compacting means adjacent thereto, said aspirating jet being equipped with means for dissipating aspirating fluid, the improvement comprising employing a low pressure aspirating jet comprising an inner trumpet shaped member positioned within an outer trumpet shape member, said inner and outer trumpet shaped members being fabricated such that when assembled a plenum chamber is provided which encircles substantially all of said inner trumpet shaped member, said outer trumpet shaped member being provided with a low pressure air entry and said inner trumpet shaped member having a stem portion, said stem portion being fluted at the exit portion thereof with longitudinally extending flute members said flute members being substantially parallel to said stem portion so as to produce a flow straightening zone whereby air entering said plenum chamber is caused to flow in a direction substantially axially of said continuous filament tow due to the fluid vectoring action of said flute members.

2. The apparatus of claim 1 wherein the plenum chamber volume to flow straightening zone volume is from 340 to 715.

3. The apparatus of claim 2 wherein said means for dissipating aspirating fluid is a perforated funnel member.

4. The apparatus of claim 3 wherein the perforations of said funnel are positioned nearest the exit end of said funnel.

* * * * *